US005747176A

United States Patent [19]

Talvalkar et al.

[11] Patent Number: 5,747,176

[45] Date of Patent: May 5, 1998

[54] ULTRA HIGH SCRATCH AND SMEAR RESISTANT IMAGES FOR SYNTHETIC RECEIVERS

[75] Inventors: Shashi G. Talvalkar, Kettering; Marion E. McCreight, West Carrollton, both of Ohio

[73] Assignee: NCR Corporation, Dayton, Ohio

[21] Appl. No.: 560,563

[22] Filed: Nov. 20, 1995

[51] Int. Cl.[6] ..... B41M 5/26

[52] U.S. Cl. ..... 428/484; 428/195; 428/323; 428/327; 428/488.1; 428/913; 428/914

[58] Field of Search ..... 428/195, 500, 428/484, 488.1, 522, 913, 914, 524, 323, 327

[56] References Cited

U.S. PATENT DOCUMENTS

| | | | |
|---|---|---|---|
| 3,663,278 | 5/1972 | Blose et al. . | |
| 4,315,643 | 2/1982 | Tokunaga . | |
| 4,403,224 | 9/1983 | Winowski . | |
| 4,463,034 | 7/1984 | Tokunaga et al. . | |
| 4,523,207 | 6/1985 | Lewis et al. . | |
| 4,627,997 | 12/1986 | Ide | 428/207 |
| 4,628,000 | 12/1986 | Talvalkar et al. . | |
| 4,644,028 | 2/1987 | Fischer et al. . | |
| 4,687,701 | 8/1987 | Knirsch et al. . | |
| 4,698,268 | 10/1987 | Ueyama . | |
| 4,707,395 | 11/1987 | Ueyama et al. . | |
| 4,777,079 | 10/1988 | Nagamoto et al. . | |
| 4,778,729 | 10/1988 | Mizobuchi . | |
| 4,869,941 | 9/1989 | Ohki . | |
| 4,923,749 | 5/1990 | Talvalkar . | |
| 4,975,332 | 12/1990 | Shini et al. . | |
| 4,983,445 | 1/1991 | Ueyama | 428/195 |
| 4,983,446 | 1/1991 | Taniguchi et al. . | |
| 4,988,563 | 1/1991 | Wehr . | |
| 5,002,819 | 3/1991 | Tohma et al. | 428/488.1 |
| 5,128,308 | 7/1992 | Talvalkar . | |
| 5,240,781 | 8/1993 | Obatta et al. . | |
| 5,248,652 | 9/1993 | Talvalkar . | |
| 5,348,348 | 9/1994 | Hanada et al. . | |

*Primary Examiner*—Pamela R. Schwartz
*Attorney, Agent, or Firm*—Richard J. Traverso

[57] ABSTRACT

There is provided by the present invention a thermal transfer ribbon which provides images with high resistance to scratch and smear through the use of high loadings of water soluble, dispersible and emulsifiable thermoplastic resins with a water dispersible or emulsifiable wax. The thermoplastic resins are sufficiently compatible with the wax so as not to separate at high concentrations of thermoplastic resin and wax. Coating formulations which provide these thermal transfer ribbons and the images obtained from such ribbons are also provided.

8 Claims, 1 Drawing Sheet

ULTRA HIGH SCRATCH AND SMEAR RESISTANT IMAGES FOR SYNTHETIC RECEIVERS

FIELD OF THE INVENTION

The present invention relates to thermal transfer printing wherein images are formed on a receiving substrate by heating extremely precise areas of a print ribbon with thin film resistors. Heating of the localized area causes transfer of ink or other sensible material from the ribbon to the receiving substrate. The sensible material is typically a pigment or dye which can be detected visually, optically or magnetically.

BACKGROUND OF THE INVENTION

Thermal transfer printing has displaced impact printing in many applications due to advantages such as the relatively low noise levels which are attained during the printing operation. Thermal transfer printing is widely used in special applications such as in the printing of machine readable bar codes and magnetic alpha-numeric characters. The thermal transfer process provides great flexibility in generating images and allows for broad variations in style, size and color of the printed image. Representative documentation in the area of thermal transfer printing includes the following patents.

U.S. Pat. No. 3,663,278, issued to J. H. Blose et al. on May 16, 1972, discloses a thermal transfer medium having a coating composition of cellulosic polymer, thermoplastic resin, plasticizer and a "sensible" material such as a dye or pigment.

U.S. Pat. No. 4,315,643, issued to Y. Tokunaga et al. on Feb. 16, 1982, discloses a thermal transfer element comprising a foundation, a color developing layer and a hot melt ink layer. The ink layer includes heat conductive material and a solid wax as a binder material.

U.S. Pat. No. 4,403,224, issued to R. C. Winowski on Sep. 6, 1983, discloses a surface recording layer comprising a resin binder, a pigment dispersed in the binder, and a smudge inhibitor incorporated into and dispersed throughout the surface recording layer, or applied to the surface recording layer as a separate coating.

U.S. Pat. No. 4,463,034, issued to Y. Tokunaga et al. on Jul. 31, 1984, discloses a heat-sensitive magnetic transfer element having a hot melt or a solvent coating.

U.S. Pat. No. 4,523,207, issued to M. W. Lewis et al. on Jun. 11, 1985, discloses a multiple copy thermal record sheet which uses crystal violet lactone and a phenolic resin.

U.S. Pat. No. 4,628,000, issued to S. G. Talvalkar et al. on Dec. 9, 1986, discloses a thermal transfer formulation that includes an adhesive-plasticizer or sucrose benzoate transfer agent and a coloring material or pigment.

U.S. Pat. No. 4,687,701, issued to K. Knirsch et al. on Aug. 18, 1987, discloses a heat sensitive inked element using a blend of thermoplastic resins and waxes.

U.S. Pat. No. 4,698,268, issued to S. Ueyama on Oct. 6, 1987, discloses a heat resistant substrate and a heat-sensitive transferring ink layer. An overcoat layer may be formed on the ink layer.

U.S. Pat. No. 4,707,395, issued to S. Ueyama et al., on Nov. 17, 1987, discloses a substrate, a heat-sensitive releasing layer, a coloring agent layer, and a heat-sensitive cohesive layer.

U.S. Pat. No. 4,777,079, issued to M. Nagamoto et al. on Oct. 11, 1988, discloses an image transfer type thermosensitive recording medium using thermosoftening resins and a coloring agent.

U.S. Pat. No. 4,778,729, issued to A. Mizobuchi on Oct. 18, 1988, discloses a heat transfer sheet comprising a hot melt ink layer on one surface of a film and a filling layer laminated on the ink layer.

U.S. Pat. No. 4,869,941, issued to Ohki on Sep. 26, 1989, discloses an imaged substrate with a protective layer laminated on the imaged surface.

U.S. Pat. No. 4,923,749, issued to Talvalkar on May 8, 1990, discloses a thermal transfer ribbon which comprises two layers, a thermal sensitive layer and a protective layer, both of which are water based.

U.S. Pat. No. 4,975,332, issued to Shini et al. on Dec. 4, 1990, discloses a recording medium for transfer printing comprising a base film, an adhesiveness improving layer, an electrically resistant layer and a heat sensitive transfer ink layer.

U.S. Pat. No. 4,983,446, issued to Taniguchi et al. on Jan. 8, 1991, describes a thermal image transfer recording medium which comprises as a main component, a saturated linear polyester resin.

U.S. Pat. No. 4,988,563, issued to Wehr on Jan. 29, 1991, discloses a thermal transfer ribbon having a thermal sensitive coating and a protective coating. The protective coating is a wax-copolymer mixture which reduces ribbon offset.

U.S. Pat. Nos. 5,128,308 and 5,248,652, issued to Talvalkar, each disclose a thermal transfer ribbon having a reactive dye which generates color when exposed to heat from a thermal transfer printer.

And, U.S. Pat. No. 5,240,781, issued to Obatta et al., discloses an ink ribbon for thermal transfer printers having a thermal transfer layer comprising a wax-like substance as a main component and a thermoplastic adhesive layer having a film forming property.

There are some limitations on the applications for thermal transfer printing. For example, the properties of the thermal transfer formulation which permit transfer from a carrier to a receiving substrate can place limitations on the permanency of the printed matter. Printed matter from conventional processes can smear or smudge, especially when subjected to a subsequent sorting operation. Additionally, where the surface of a receiving substrate is subject to scratching, the problem is compounded. This smearing can make character recognition such as optical character recognition or magnetic ink character recognition difficult and sometimes impossible. In extreme cases, smearing can make it difficult to read bar codes.

Many attempts have been made to provide high integrity thermal transfer printing which is resistant to scratching and smearing, some of which are described above. For example, Talvalkar provides print with improved smear resistance from a thermal transfer formulation which contains thermally reactive materials in U.S. Pat. Nos. 5,128,308 and 5,248,652. For non-reactive thermal transfer formulations, it is generally known to those skilled in the art that higher melting resins and/or waxes can provide a higher degree of scratch and smear resistance. To achieve very high scratch and smear resistant images, a synthetic resin receiving substrate is often used. Commercially available receiving substrates include thermafilm PM-200 (white and clear) and others such as Tyvac®, polyethylene, polypropylene, polyester and acetate. While thermal transfer materials for these substrates are known, it is desirable to provide materials which are not dependent on the use of organic solvents. The use of water-based systems or water-rich systems will simplify compliance with environmental regulations and restrictions.

SUMMARY OF THE INVENTION

It is the object of the present invention to provide a coating formulation which provides printed images on synthetic resin receiving substrates which are highly resistant to scratching and smearing.

It is the further object of the present invention to provide a thermal transfer ribbon which provides images on synthetic resin receiving substrates which are highly scratch and smear resistant.

It is another object of the present invention to provide a water-based or water-rich coating formulation, and thermal transfer ribbon obtained therefrom, which provide highly scratch and smear image resistant images on synthetic resin receiving substrates.

These and other objects and advantages of the present invention will become apparent and further understood from the detailed description and claims which follow, together with the annexed drawings.

The above objects are achieved through the use of a wax and thermoplastic resin which are soluble, dispersible or emulsifiable in aqueous media and are sufficiently compatible such that the thermoplastic resin does not precipitate from aqueous solutions, dispersions or emulsions containing 2 to 25 wt. % wax and 25 to 75 wt. % thermoplastic resin, based on the total weight of dry ingredients.

There is provided by this invention a coating formulation comprising an aqueous dispersion, solution or emulsion of wax, pigment and thermoplastic resin wherein the wax and thermoplastic resin are water soluble, dispersible or emulsifiable and the wax and thermoplastic resin are sufficiently compatible such that the thermoplastic resin does not precipitate from an aqueous emulsion, dispersion or solution of wax and thermoplastic resin.

In another aspect of the present invention, there is provided a thermal transfer ribbon for depositing scratch and smear resistant images on a synthetic resin receiving substrate, said thermal transfer ribbon comprising a flexible substrate with a coating of thermal transfer material positioned on said substrate which comprises a pigment dispersed in a binder comprised of water dispersible or emulsifiable wax and a water soluble, dispersible or emulsifiable thermoplastic resin. The wax and thermoplastic resin have similar softening points so as to uniformly transfer from the flexible substrate to the synthetic receiving substrate upon the application of heat sufficient to soften the thermally sensitive coating. The wax and thermoplastic resin are also sufficiently compatible such that the thermoplastic resin does not separate from an aqueous dispersion or emulsion containing both wax and thermoplastic resin.

An additional aspect of this invention is a label with a printed image which is highly resistant to scratch and smear which comprises a synthetic resin receiving substrate and an image comprising a layer of pigment dispersed in a binder which comprises aqueous dispersible or emulsifiable wax and a water soluble, dispersible or emulsifiable thermoplastic resin.

DETAILED DESCRIPTION OF THE PREFERRED EMBODIMENTS

Figure 1:
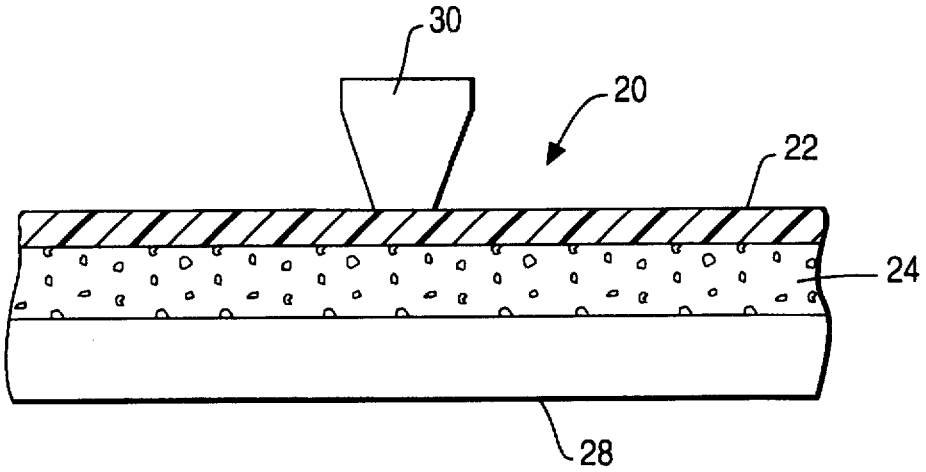
FIG. 1 illustrates a thermal transfer medium of the present invention in a printing operation prior to thermal transfer.
Figure 2:
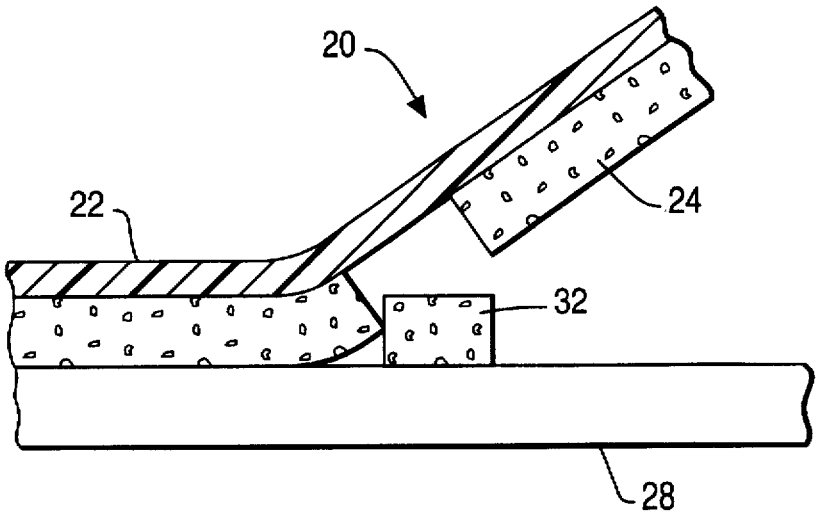
FIG. 2 illustrates a thermal transfer medium of the present invention in a printing operation after thermal transfer.

Thermal transfer ribbon 20, as illustrated in FIGS. 1–2, is a preferred embodiment of this invention and comprises substrate 22 of a flexible material which is preferably a thin smooth paper or plastic-like material. Tissue type paper materials such as 30–40 gauge capacitor tissue, manufactured by Glatz and polyester-type plastic materials such as 14–35 gauge polyester film manufactured by Dupont under the trademark Mylar® are suitable. Polyethylene napthalate films, polyamide films such as nylon, polyolefin films such as polypropylene film, cellulose films such as triacetate film and polycarbonate films are also suitable. The substrates should have high tensile strength to provide ease in handling and coating and preferably provide these properties at minimum thickness and low heat resistance to prolong the life of heating elements within thermal print heads. The thickness is preferably 3 to 50 microns. If desired, the substrate or base film may be provided with a backcoating on the surface opposite the thermal transfer layer.

Positioned on substrate 22 is thermal transfer layer 24. The thermal sensitivity of thermal transfer layer 24 is determined by the softening point of the binder. This thermal transfer layer has a softening point below 300° C., preferably below 250° C. and most preferably from 150° C. to 200° C. Softening temperatures within this range enable the thermal transfer medium to be used in conventional thermal transfer printers, which typically have print heads which operate at temperatures in the range of 50° C. to 250° C., more typically, temperatures in the range of 150° F. to 300° F. The binder within the thermal transfer coating contains a wax and thermoplastic resin which are compatible so that exposure to heat from print head 30 uniformly transfers thermal transfer layer 24 from substrate 22 to synthetic resin receiving substrate 28 and form image 32.

The coating formulations and the thermal transfer material of thermal transfer ribbons of this invention contain a water dispersible or emulsifiable wax. Such waxes can be natural waxes such as carnauba wax, candelilla wax, bees wax, rice bran wax; petroleum waxes such as paraffin wax; synthetic hydrocarbon waxes such as low molecular weight polyethylene and Fisher-Tropsch wax; higher fatty acids such as myristic acid, palmitic acid, stearic acid and behenic acid; higher aliphatic alcohols such as stearyl alcohol and esters such as sucrose fatty acid esters. Mixtures of waxes can also be used. Examples of preferred waxes are carnauba wax under the Slip-Ayd series of surface conditioners by Daniel Products Co. and low molecular weight polyethylene. The melting point of the wax falls within the range of from 75° C. to 250° C., preferably from 75° C. to 200° C. Waxes with melting points at the high end are advantageous in that they aid in the integrity of the printed image. The amount of wax used in the coating formulation and thermal transfer materials of the thermal transfer ribbons of the present invention is above 5 wt % based on the dry ingredients, preferably 10 to 50 wt. %. Coating formulations typically comprise 20 to 50 wt. % total solids. This translates at least to 0.01 to 0.02 wt. % wax based on the total formulation.

Preferred formulations have from 2–25 wt. % wax based on the total formulation. To aid in processing, rheology and compatibility with thermoplastic resin, micronized grades of wax are preferred.

The coating formulations and the thermal transfer materials of the thermal transfer ribbons of this invention also contain a water soluble, dispersible or emulsifiable thermoplastic resin. Suitable thermoplastic resins include those described in U.S. Pat. Nos. 5,240,781 and 5,348,348 and the following resins: polyvinylchloride, polyvinyl acetate, vinyl chloride-vinyl acetate copolymers, polyethylene, polypropylene, polyacetal, ethylene-vinyl acetate copolymer, ethylene alkyl (meth)acrylate copolymer, ethylene-ethyl acetate copolymer, polystyrene, styrene copolymers, polyamide, ethylcellulose, epoxy resin, polyketone resin, polyurethane resin, polyvinyl butyryl, styrene-butadiene rubber, nitrile rubber, acrylic rubber, ethylene-propylene rubber, ethylene alkyl (meth)acrylate copolymer, styrene-alkyl (meth)acrylate copolymer, acrylic acid-ethylene-vinyl acetate terpolymer, saturated polyesters, and sucrose benzoate. Preferred resins include sucrose benzoate, polyethylene, polyketone resins and styrene copolymers. To obtain emulsions of thermoplastic resins which are insoluble or poorly soluble in water, the thermoplastic resin is typically ground to submicron size.

Preferred thermal transfer material and coating formulations contain two or more resins to provide specific property profiles. For example, Piccotex resins by Hercules are hydrocarbon resins (vinyl toluene-alpha methyl styrene copolymers) that provide high hot tack properties which aid adhesion of the coating to the synthetic resin receiving substrate upon transfer. Polyethylene SL 300, a polyethylene resin emulsion of a small (submicron) particle size is a surface conditioner within the Slip-Ayd series by Daniel Products which provides slip or wax-like properties for transfer. These thermoplastic resins can be used together or with other resins to provide a specific property profile.

In addition to special properties such as these, the thermoplastic resin provides a higher melting point for the thermal transfer materials than the wax so that the image resulting therefrom exhibits high smear and scratch resistance. The thermoplastic resin has a melting/softening point of less than 300° C. and preferably in the range of 95° C. to 250° C. To provide high scratch and smear resistant images on synthetic resin substrates, the thermoplastic resin comprises at least 25 wt. %, based on total dry ingredients, of the thermal transfer layer and the coating formulation. In preferred embodiments, the thermoplastic resin comprises 35 wt. % to 75 wt. % of the total dry ingredients. This high loading of thermoplastic resin provides images with high scratch and smear resistance. This translates to coating formulations with at least 5 wt % to 10 wt %, thermoplastic resin based on the weight of the total formulation, and preferred formulations having from 7 wt % to 35 wt % thermoplastic resin, based on the weight of the total formulation. The thermoplastic resin must be compatible with the wax such that it does not separate out in aqueous dispersions or emulsions which contain 2 to 25 wt % wax, based on the total weight of said dispersion or emulsion. Such compatibility is necessary to ensure a high loading of thermoplastic resin for producing images with high scratch and smear resistance. To enhance compatibility, i.e., minimize separation, it is preferable for the thermoplastic resin and wax particles in emulsions and dispersions to be submicron size particles.

A key element of the thermal transfer layer of the present invention is a sensible material which is capable of being sensed visually, by optical means, by magnetic means, by electroconductive means or by photoelectric means. The sensible material is typically a coloring agent such as a dye or pigment or magnetic particles. Any coloring agent used in conventional ink ribbons is suitable, including carbon black and a variety of organic and inorganic coloring pigments and dyes. For example, phthalocyanine dyes, fluorescent naphthalimide dyes and others such as cadmium, primrose, chrome yellow, ultra marine blue, iron oxide, cobalt oxide, nickel oxide, etc. In the case of the magnetic thermal printing, the thermal transfer coating includes a magnetic pigment or particles for use in imaging or in coating operations to enable optical, human or machine reading of the characters. The magnetic thermal transfer ribbon 20 provides the advantages of thermal printing while encoding or imaging the substrate with a magnetic signal inducible ink. The sensible material is typically used in an amount from about 5 to 60 parts by weight of the total dry ingredients for the coating formulation which provides the thermal transfer layer.

The thermal transfer layer may contain plasticizers, such as those described in U.S. Pat. No. 3,663,278, to aid in processing of the thermal transfer layer. Suitable plasticizers are adipic acid esters, phthalic acid esters, ricinoleic acid esters sebasic acid esters, succinic acid esters, chlorinated diphenyls, citrates, epoxides, glycerols, glycols, hydrocarbons, chlorinated hydrocarbons, phosphates, and the like. The plasticizer provides low temperature sensitivity and flexibility to the thermal transfer layer so as not to flake off the substrate. The thermal transfer layer may contain other additives including flexibilizers such as oil, weatherability improvers such a UV light absorbers, and fillers.

Preferred thermal transfer ribbons contain coatings of thermal transfer material which comprise 10 to 25 wt. % wax, 40 to 65 wt. % thermoplastic resin and 5 to 40 wt. % pigment based on the total weight of dry ingredients.

The thermal transfer ribbon of the present invention can be prepared by applying a coating to the substrate by conventional coating techniques such as a Meyer Rod or like wire-round doctor bar set up on a typical solvent coating machine to provide a coating thickness preferably in the range of 0.0001 to 0.0004 inches. These coating thicknesses equate to a coating weight of preferably between 4 and 16 milligrams per four square inches. Suitable thermal transfer layers are derived from coating formulations having approximately 20 to 55 percent dry ingredients (solids). A temperature of approximately 100° F. to 150° F. is maintained if necessary during the entire coating process. After the coating is applied to the substrate, the substrate is passed through a dryer at an elevated temperature to ensure drying and adherence of the coating 24 onto the substrate 22 in making the transfer ribbon 20. The above-mentioned coating weight as applied by the Meyer Rod onto a preferred 9 to 12 μm thick substrate translates to a total thickness of 7 to 15 μm. The thermal transfer layer can be fully transferred onto a receiving substrate at a temperature in the range of 150° C. to 300° C.

The thermal transfer ribbon provides the advantages of thermal printing. When the thermal transfer layer is exposed to the heating elements (thin film resistor) of the thermal print head, the thermal transfer layer is transferred from the ribbon to the receiving substrate in a manner to produce precisely defined characters 32 on the document for recognition by the reader. In the case of non-magnetic thermal printing, the image transferred to document 28 defines characters or codes for optical recognition by a machine or human.

The coating formulation of this invention contains the above-identified solid materials, in the proportions described, in a solution, dispersion or emulsion. Preferably, the solution, dispersion or emulsion is water-rich comprising primarily water and alkanols such as propanol. The coating formulation typically contains the solids in an amount in the range of about 20 to 55 weight percent. Preferably, the coating formulation contains about 25–40 at percent solids. To prepare the coating formulation of the present invention, the ingredients are typically combined as an aqueous emulsion in a ball mill or similar conventional grinding equipment and agitated. Typically, the solids are added as dispersions at about 30 weight percent solids. The wax emulsion is typically the initial material and the remaining components added thereto with minor heating. The composition of the coating formulation and the thermal transfer layer can be controlled so as to adjust the temperature at which the coating is transferred to the receiving substrate.

The labels provided by this invention comprise a synthetic resin substrate and a layer comprising a sensible material, 25 to 75 wt. % thermoplastic resin and 2 to 25 wt. % wax, based on the weight of the total solids and wherein the thermoplastic resin and wax are water dispersible or emulsifiable as submicron sized particles.

Without further elaboration, it is believed that one skilled in the art can, using the preceding description, utilize the present invention to its fullest extent. The following preferred specific embodiments are, therefore, to be construed as merely illustrative, and not limitative of the remainder of the disclosure in any way whatsoever.

The entire disclosure of all applications, patents and publications, cited above and below, are hereby incorporated by reference.

EXAMPLE 1

A coating formulation of the present invention was prepared by adding the following ingredients in Table 1 with a small amount of DOP (Di-octyl-phthalate) plasticizer to a quart sized attritor and grinding for about 45 minutes.

TABLE 1

| INGREDIENT | PERCENT DRY | WET AMOUNT | RANGE (% Dry) |
|---|---|---|---|
| EC-1052 (Latex @ 40%) (Adhesive Resin) | 20.0 | 50.0 | 20–40 |
| Carnauba Emulsion @ 25%) (Wax) | 2.0 | 8.0 | 2–10 |
| Acrylic Black (KS-1720 @ 40%) (Pigment dispersed in resin) | 5.0 | 12.5 | 4–20 |
| Polyethylene Emulsion (@ 40%) (Wax-like resin) | 12.0 | 30.0 | 10–40 |
| Water | — | 155.5 | |
| Sucrose Benzoate (25% in NPA) (Resin) | 61.0 | 244.0 | 40–70 |
| Total | 100.0 | 500.0 | Final Solids 20% |

Preparation of a Thermal Transfer Ribbon and Image

The formulation of Example 1 was coated on 18 gauge polyester film at about a 6–7 miligrams/4 sq. in. coat weight and dried at 180° F. to obtain a thermal transfer ribbon of the present invention. Full transfer of the coating from the ribbon was observed on a stepwedge at a temperature in the range of 260° F.–300° F. Barcodes were printed from the thermal transfer ribbon on a polyester receiving substrate (Flexcon) using of TEC B-30 thermal transfer printer at +2V setting.

Scratch and Smear Test

The barcode images produced were tested for smear resistance by making 10 passes of a pad (0.25 in$^2$) over the barcode under a force of 2 kgms. The image was tested for scratch resistance by making 10 passes of a bearing point over the image under a force of 2 kgms. Distortion of the images obtained was not observed following these tests.

EXAMPLE 2

A coating formulation containing the following components was prepared as described in Example 1 (without plasticizer).

TABLE 2

| INGREDIENT | PERCENT DRY | WET AMOUNT | RANGE (% Dry) |
|---|---|---|---|
| Black Latex (EC-9724 @ 40%) (Pigment dispersed resin) | 28.0 | 70.0 | 20–40 |
| Polyethylene (SL-300 @ 30%) (Wax-like Resin) | 12.0 | 40.0 | 10–30 |
| Water | — | 30.0 | — |
| N-Propanol | — | 150.00 | — |
| Calcium Carbonate (Pigment) | 10.0 | 10.0 | 5–25 |
| Sucrose Benzoate (25% in NPA) (Resin) | 50.0 | 200.0 | 40–70 |
| Total | 100.0 | 500.0 | Final Solids 20% |

Preparation of Thermal Transfer Ribbon and Image

A thermal transfer ribbon of this invention was obtained by depositing the above formulation on 18 gauge polyester film at a coat weight of about 6–7 milligrams/4 sq. in. and dried at 180° F. Full transfer of the coating from a step-wedge was observed at 300° F. Barcodes were printed from a TEC B-30 thermal transfer printer at +2V setting on plastic substrates and showed excellent resistance to scratch and smear following tests performed as in Example 1.

EXAMPLE 3

A coating formulation of the present invention comprising the following ingredients was prepared as described in Example 1 (without plasticizer).

TABLE 3

| INGREDIENT | PERCENT DRY | WET AMOUNT | RANGE (% Dry) |
|---|---|---|---|
| Piccotex 120 (Styrene Copolymer Resin) | 61.0 | 61.0 | 40–70 |
| Water | — | 256.5 | |
| EC-1052 Latex (@ 40%) (Adhesive Resin) | 20.0 | 50.0 | 10–30 |
| Acrylic Black (KS-1725 @ 40%) (Pigment Dispersed in Resin) | 7.0 | 17.5 | 4–20 |
| Polyethylene Emulsion (@ 40%) (Wax-like Resin) | 12.0 | 30.0 | 8–30 |
| N Propanol | — | 40.0 | |
| Total | 100.0 | 500.0 | Final Solids 20% |

Thermal Transfer Ribbon and Image

A thermal transfer ribbon was prepared by diluting this dispersions of solids to about 15 wt. % solids with 10/90 NPA/Water. The coating was applied at about 7 milligrams/4 sq. in. on 18 gauge polyester film as described in Example 1. Full transfer of the coating was observed at 245° F. on a step-wedge. Barcodes were printed using a TEC B-30 thermal transfer printer and the images tested for scratch and smear resistance. The scratch and smear resistance was acceptable, but not as good as the sucrose benzoate system of Example 1 due to the lower transfer temperature.

EXAMPLE 4

The coating formulation having the following components was prepared consistent with the procedures described in Example 1.

TABLE 4

| INGREDIENT | PERCENT DRY | WET AMOUNT | RANGE (% Dry) |
|---|---|---|---|
| K-1717 (@ 30% solution) (Thermoplastic Polyketone Resin) | 35.0 | 105.0 | 30–60 |
| Ethyl Cellulose N4 (@ 10%) (Thermoplastic Resin) | 5.0 | 50.0 | 4–12 |
| Calcium Carbonate (Pigment) | 14.0 | 14.0 | 10–20 |
| S-Nauba 5021 (Carnauba) (Wax) | 4.0 | 4.0 | 2–30 |
| Polyethylene (S-395-N2) (Thermoplastic Resin) | 21.0 | 21.0 | 8–30 |
| EC-1052 Latex (@ 40%) (Adhesive Resin) | 10.0 | 25.0 | 5–20 |
| Acrylic Black (KS-1720 @ 40%) (Pigment Dispersed Resin) | 10.0 | 25.0 | 5–20 |
| Polyox N-10 (@ 20%) (Plasticizer) | 1.0 | 5.0 | 1–5 |
| Water | — | 126.0 | — |
| N-Propanol | — | 125.0 | — |
| Total | 100.0 | 500.0 | Final Solids 20% |

The carnauba wax was micronized grade available from Shamrock Inc.

Thermal Transfer Ribbon and Image

The above formulation was coated using a pilot coater on 18 gauge polyester film at about 6.5 milligrams/4 sq. in. coating weight. Full transfer using a step-wedge was observed at 260° F. Barcodes were printed on plastic substrates using the TEC B-30 printer described above and showed good resistance to scratch and smear following the test procedures described in Example 1. It is recognized that the acrylic black latex can be replaced with other colors or other latex materials such as blue (Acrylic Blue HS-1720 by Heucotech) and purple (EH-50814 Latex and HS-1520 Acrylic Blue). A green colored coating was recorded using a combination of blue and yellow latex (EP-2092 and OS 1450).

The preceding examples can be repeated with similar success by substituting the generically or specifically described reactants and/or operating conditions of this invention for those used in the preceding examples.

From the foregoing description, one skilled in the art can easily ascertain the essential characteristics of this invention, and without departing from the spirit and scope thereof, can make various changes and modifications of the invention to adapt it to various usages and conditions.

What is claimed is:

1. A thermal transfer ribbon for depositing scratch and smear resistant images on a synthetic resin receiving substrate with a thermal printer, said thermal transfer ribbon comprising:

a flexible substrate with a coating of a thermal transfer material positioned thereon, said thermal transfer material comprising a colored pigment dispersed in a binder, said binder comprising:

25 to 75 wt. %, based on total dry ingredients, of a water soluble, water dispersible or water emulsifiable thermoplastic resin having a softening point in the range of 95° C. to 250° C. and 10 to 50 wt. %, based on total dry ingredients, of a water dispersible or water emulsifiable wax, having a softening point in the range of 75° C. to 250° C., said wax and thermoplastic resin being sufficiently compatible such that the thermoplastic resin remains in an aqueous dispersion or emulsion containing 25 wt. % wax and 35 wt. % thermoplastic resin, based on the total weight of said aqueous emulsion or dispersion without precipitation;

wherein the thermoplastic resin is selected from the group consisting of sucrose benzoate, polyketone resins and styrene copolymers.

2. A thermal transfer ribbon as in claim 1 which additionally comprises a plasticizer selected from the group consisting of hydrocarbons, chlorinated hydrocarbons, phthlatic acid esters, glycerols, chlorinated diphenyls, adipic acid esters, glycols, epoxides and citrates.

3. A thermal transfer ribbon as in claim 1, wherein the coating of thermal transfer material comprising thermoplastic resin is formed from a solution, emulsion or dispersion of thermoplastic resin particulates of submicron particle size.

4. A thermal transfer ribbon as in claim 1, wherein the thermal transfer material contains at least 40 wt. % thermoplastic resin, based on total dry ingredients.

5. A thermal transfer ribbon as in claim 1, wherein the thermal transfer material contains at least 50 wt. % of thermoplastic resin, based on total dry ingredients.

6. A thermal transfer ribbon as in claim 1, wherein the coating of thermal transfer material comprising a wax is formed from an aqueous dispersion or emulsion of wax particulates of submicron size.

7. A thermal transfer ribbon as in claim 1 which comprises 5–40 wt. % pigment based on the total weight of dry ingredients.

8. A thermal transfer ribbon as in claim 7, wherein the pigment is selected from the group consisting of carbon black and calcium carbonate.

* * * * *